United States Patent [19]

Kelly

[11] 4,285,302

[45] Aug. 25, 1981

[54] BOILER BLOWDOWN SYSTEM

[76] Inventor: Thomas J. Kelly, 537 N. Euclid, Oak Park, Ill. 60302

[21] Appl. No.: 972,892

[22] Filed: Dec. 26, 1978

[51] Int. Cl.[3] ..... F22B 37/54

[52] U.S. Cl. ..... 122/382; 122/396

[58] Field of Search ..... 122/381, 382, 389, 396, 122/403

[56] References Cited

U.S. PATENT DOCUMENTS

| | | | |
|---|---|---|---|
| 2,597,597 | 5/1952 | Rice | 122/382 |
| 3,908,605 | 9/1975 | Andersen | 122/382 |
| 4,070,992 | 1/1978 | Holdt | 122/382 |

*Primary Examiner*—Edward G. Favors

*Attorney, Agent, or Firm*—Bruce K. Thomas

[57] ABSTRACT

An apparatus and method for automatically blowing down a boiler are disclosed, wherein the discharged sediment-containing water is drawn off to an intermediate receiver or holding tank for a short interval and then sent through a heat exchanger which is isolated for the boiler. The condition of the water in the boiler is continuously monitored by conductivity sensors to begin each blowdown cycle when the conductivity reaches a predetermined level. A three-way valve connected to the bottom blowdown line of the boiler is opened automatically and the blowdown water is forced out of the boiler under the steam pressure to the receiver and sent by means of the same valve to a heat exchanger. This is accomplished by allowing steam from the boiler to enter the receiver to displace the blowdown water, and sweep non-condensibles therefrom. The flow of blowdown water through the heat exchanger is strictly regulated to meet design requirements and at the same time, the receiver tank is isolated from the boiler and fresh water is introduced into the boiler to replace that which was removed by the blowdown. The method is applicable to installation on a multi-boiler system.

19 Claims, 3 Drawing Figures

BOILER BLOWDOWN SYSTEM

One feature of the invention is a by-pass from the top of the receiver tank to the bottom of the boiler. The by-pass line includes a one-way check valve allowing flow only from the top of the receiver to the boiler. With no intervening valves this line serves as an over pressure relief outlet from the tank to the boiler which is protected by pressure relief devices that open at or below the maximum safe working pressure of the boiler and the receiving tank. This precludes accidental damage of the boiler. This method of relief does not provide any flow path from the bottom of the boiler to atmosphere as would be the case if a conventional relief valve were on the receiver.

BACKGROUND OF THE INVENTION

The water in steam boiler systems is lost through air vents, steam leaks, the condensation of steam that is purposely not returned to avoid contamination of the boiler and through consumption in industrial process using live steam which cannot be returned to the boiler.

The quantity of water to be removed from the steaming boiler, for the necessary purpose of reducing the amount of solid matter present in the boiler, varies greatly with different steam boiler plants. However, the losses in water must be replaced with make-up water if the boiler is to continue operating. The greater the load on the boiler the sooner a high concentration of solid matter occurs in the boiler water.

It is known in this art that 100% of the dilution required can be obtained by withdrawing boiler water only from the bottom of the boiler. It is, however, not possible to accomplish 100% dilution by using so-called "surface blow-off" method. The American Boiler and Affiliated Industries have established concentration limits beneath which satisfactory steam production can be expected.

In general, a maximum total solids (which includes dissolved and suspended solids) content of about 3500 PPM, maximum suspended solids content of about 300 PPM and a maximum alkalinity of 700 PPM for boilers operating at or below 300 psig pressure are acceptable.

Expensive and complicated automatic blowdown systems are known in the prior art, but these systems are not entirely reliable, calling for operations which may create risk of live steam being released to the atmosphere or conditions which otherwise do not comply with various codes and which are therefore not approved by building authorities. In the U.S. Pat. No. 3,908,605 by C. M. Andersen, there is described an apparatus and method for automatically blowing down a boiler. The boiler water containing sediments is withdrawn from the bottom of the boiler into an intermediate or holding tank. This system is severely limited to hourly blow-down capacity due to ineffeciency in heat exchange mode. This fault makes Andersen's unit completely impractical for application to high pressure boilers using large quantities of make-up water.

The sequence of steps are: pressurizing the holding tank with steam from the boiler, isolating the tank to condense the steam, blow down the boiler into the tank, expelling blowdown water and sediment from the tank and again repressurizing the tank to repeat the cycle.

This system also requires the use of considerable quantities of steam to bring the holding tank to the desired pressure, the heat of which is lost in the isolation and condensing steps and also to force the blowdown water from the bottom thereof.

Sufficient steam under pressure is used in receiving tank to create a partial vacuum therein for withdrawal of the next cycle of blowdown water, considerable heat is thereby wasted. Furthermore, the time cycle requires the use of large quantities of the cooling water for the holding tank and it is impossible to adapt such a system to boilers which require thousands of pounds of water blowdown every hour.

According to this invention, a receiving tank is used for the purpose of withdrawing the blowdown water from the boiler without significant cooling. Rather, the blowdown water is immediately cycled from the full receiving tank to a heat exchanger at a specific flow rate and the heat exchanger is isolated from the boiler so that the rate of cooling of the water is under direct and independent control. The instant invention is adapted for use with high capacity multiple-boiler installations wherein both surface water blow-off and bottom blowdown from each boiler are necessary.

DESCRIPTION OF THE DRAWINGS

Illustrated embodiments of the invention are shown in the drawings wherein.

DESCRIPTION OF THE PREFERRED EMBODIMENTS

Figure 1:
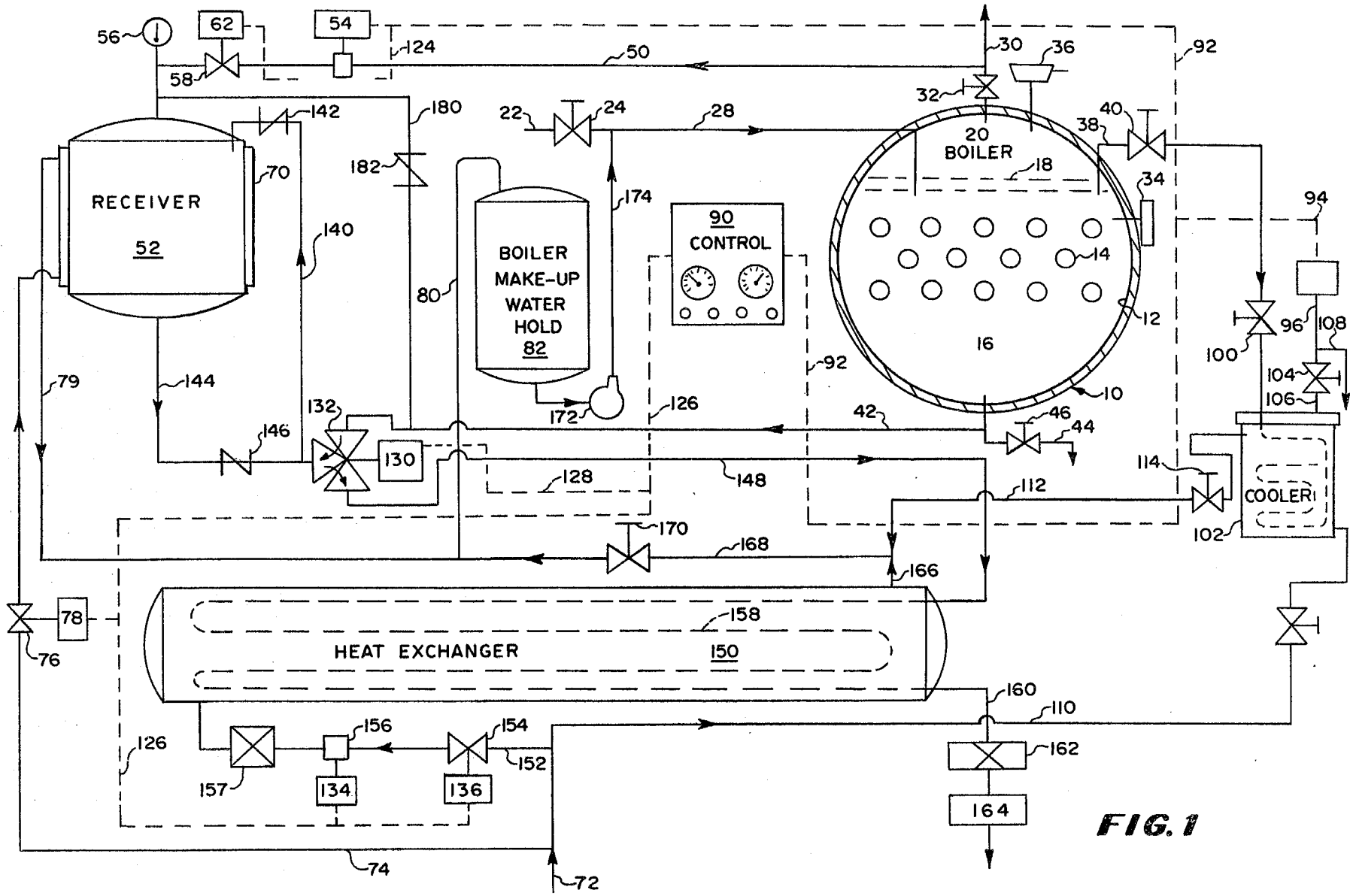
FIG. 1 is a partially schematic view or diagram of one form of apparatus of the invention, showing certain portions in section, for single boiler operation using bottom blowdown only.

Referring to FIG. 1, the boiler 10 illustrates any of several known varieties of boilers of the stationary type having a shell or sidewall 12 fitted with draft tubes 14, the heat supply for which is not illustrated. The shell defines an interior 16 containing boiler water maintained at fluctuating operating levels illustrated by the broken lines 18 so as to provide a suitable head space 20 thereabove.

Make-up water for the boiler 10 is supplied from the source 22 under the control of the valve 24 the line 28 which enters the boiler at a point below the water line 18. Steam under pressure produced by the boiler passes from the head space 20 through the line 30, to the load served by the boiler. The distribution of the steam is controlled by known means and the manual valve 32 is provided as part of the control for the steam output, primarily related to shutdown periods for the maintenance of the boiler. The boiler 10 is equipped with a low water boiler shut-off sensor 34 and other safety devices such as the safety relief valve 36.

At the top of the boiler and communicating with lowermost limit of operating level 18, there is, provided a surface blowoff line 38, controlled by the service valve 40, leading to the monitoring system to be described.

The bottom blowdown line 42 communicates with the lowest point of the interior 16 and has the branch line 44, controlled by the valve 46, for the purpose of manual draining of the boiler during maintenance.

Means for steam purging a receiver tank illustrated by the line 50, connects between the steam outlet line 30 to the top of the receiver tank 52 through and controlled by valve 58. The line 50 is equipped with suitable branch lines connected to the pressure sensor 54 and the vacuum-pressure gauge 56, each having their valves (not illustrated). The service valve 58 is solenoid operated by means of the solenoid 62, for purposes to be described.

The receiver tank 52 is a pressure vessel constructed to include an outer cooling jacket or heat exchange coil 70 adapted to receive cooling water from the source 72, shown at the bottom of the drawing, via the branch line 74 under the control of the valve 76 having the drive means 78, entering the bottom thereof, and including, the cooling water return line 79 leading from the top of the jacket to the branch line 80 which communicates with the top of the boiler make-up hold tank 82 the latter being a normal component of all such boiler plants.

Figure 3:
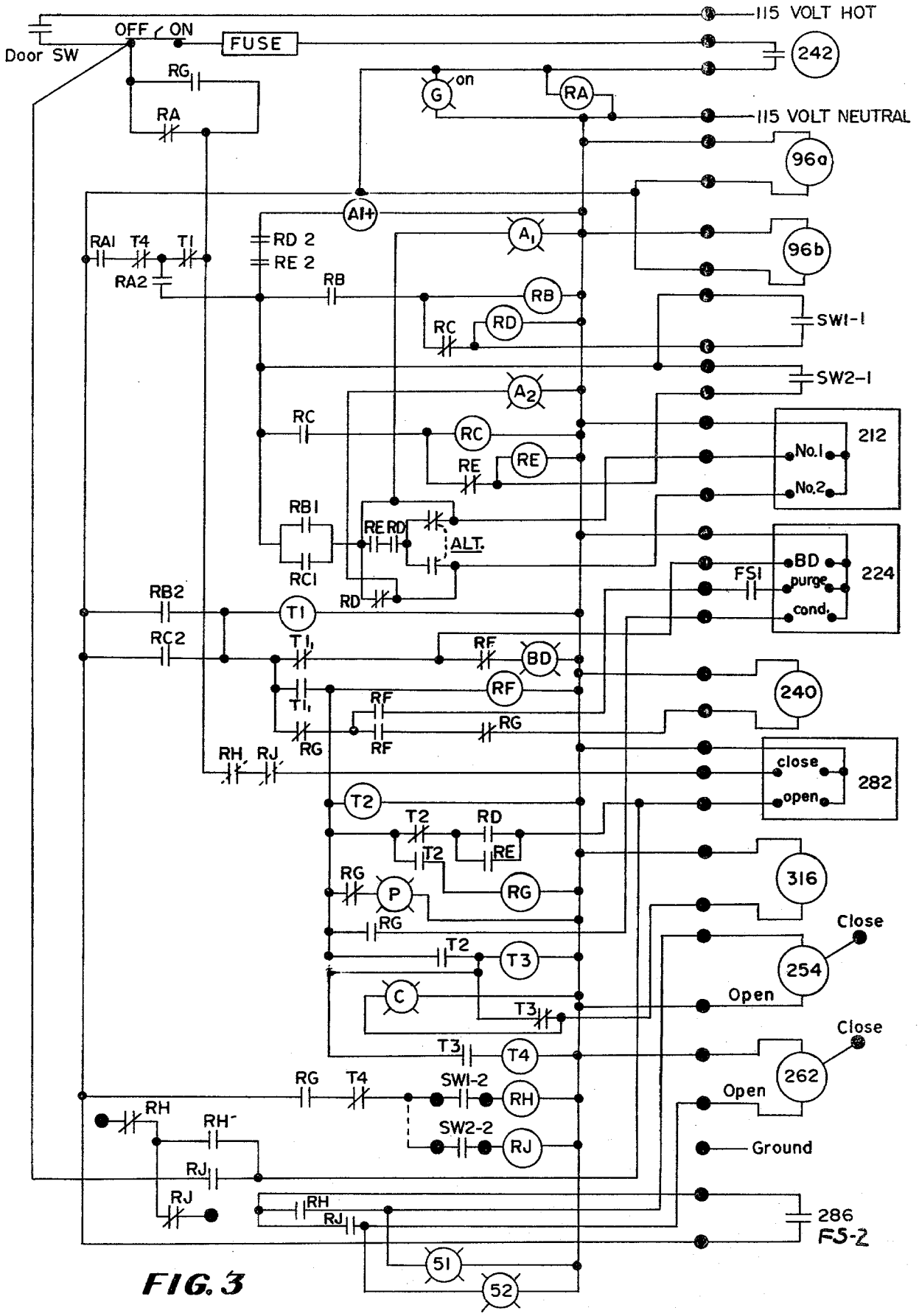

The single boiler blowdown system of FIG. 1 operates automatically under the control of the console 90 which includes the electrical or solid state elements shown in FIG. 3, to be described.

This control unit is a component of this invention and may be remote from the boiler 10 and the rest of the system, being connected thereto by electrical connections illustrated by the connections 92 and 94 leading to one or more conductivity cells 96 that continously monitor and detect the level of dissolved solids in the boiler water. Services which detect some other condition of the boiler water such as pH., can also be used. The boiler water taken from the top blow-off line 38 is under the control of the needle valve 100. About 0.1 gal per minute is drawn off for the purpose of such tests and monitoring system.

Prior to the test, the temperature of the blow-off water is reduced to a desired constant level by passage through the sample cooler 102. The flow of boiler water through the cell 96 itself is controlled by the second needle valve 104 in the line 106 after which the water passes to drain through the line 108. Coolant for the cooler 102 comes from the source 72, via the line 110, and returns to the boiler make-up water system via the line 112 controlled by the manual needle valve 114.

Control panel 90 is also connected via the multi-conductor lead 92 to pressure sensor 54 and finally to the solenoid 62 for the valve 58 by branch lead 124. This part of the system monitors the boiler water condition and controls the purging and the pressuring of the receiver 52, as will be described.

The control panel 90 connects via multi-conductor lead 126, through the branch lead 128 to the valve actuator 130, controlling the three-way valve 132 and further connects to the drive means 78 for the coolant valve 76, the flow switch control 134 and the valve motor control 136 at the bottom left corner of the drawing, though suitable branch leads.

Depending on its position, the 3-way ball-type valve 132 allows bottom blow-down water to proceed (in accordance with the indicated arrows) via the line 42 into the feed line 140 having the one-way valve 142, and into the top of the receiver 52. In another position of the valve 132, blow-down water from the receiver 52 passes via the return line 144, controlled by the one-way valve 146, into the line 148 and the heat exchanger 150. A third position of the valve 132 is complete shut off.

Cooling water from the source 72 passes through the branch line 152, the control valve 154, the flow switch 156, the flow rate regulating valve 157, into the body of the exchanger 150 wherein it is in indirect contact with and extracts heat from the blow-down water passing through the coil 158. Alternately the blow-down water may pass through the body of the heat exchanger and the coolant pass through a coil therein, depending on design preferances.

The blowdown water, now meeting the specifications as a liquid waste, is discharged to the drain via the line 160, equipped with the required back pressure valve 162 and flow rate controller 164.

Coolant from the heat exchanger passes via the lines 166 and 168, passes the service valve 170 joining with cooling water from the line 79, into the branch line 80 leading to the boiler make-up water hold tank 82. This accumulated water is circulated via the pump 172 via the line 174, as needed, into the boiler water feed line 28. The general description of FIG. 1 is completed by reference to the by-pass line 180, its one-way valve 182, the purposes of which will be described, connected to the line 42.

The operation of automatic boiler blowdown system of FIG. 1 is as follows:

All service valves in the system are opened. The flow of top blow-off water through the sample cooler 102 is established by adjusting valves 104, 100 and opening the valve 114 for cooling water for sample cooler 102. The flow to the cell in the monitor 96 is about 0.1 per minute. With the control panel 90 "ON", if pressure sensor 54 in line 50 senses a predetermined steam pressure, the normally open switch in line 50 will close, providing a circuit between a manual on/off switch, the blowdown system and the main control circuitry and control panel 90.

As soon as an increase in electrical conductivity of the boiler water (due to increase solids) in the boiler 10, is sensed by the conductivity cell 96 the blowdown cycle or BLOWDOWN phase is begun. Valve 132 is moved to its "BD" position to allow flow of boiler water from the bottom of boiler via line 42 line 140 through one-way valve 142 to receiver 52.

The circuit (FIG. 3) associated with control panel 90 includes a timer $T_1$ which by trial and error will establish the length of time of the BLOWDOWN phase e.g. the time it takes to fill receiver 52. This may easily be determined by operating the system once and observing the pressure gauge 56 which will indicate a pressure the same as that in the steam space of boiler 10 when the receiver is filled. Timer $T_1$ is set for this observed time or a slightly greater period to assure the fact receiver 52 is completely filled. When the BLOWDOWN phase is completed the PURGE phase begins automatically as follows:

The valve 154 is opened by the timer $T_1$ andd simultaneously the valve 58 opens allowing steam to flow through line 50 from steam space 20 of the boiler 10 to pressurize the receiver 52 and start cooling water circulation in the heat exchanger 150. Thus the opening of the valve 154 allows cooling water to flow from line 72 through line 152 across the paddle switch 156 into the shell of heat exchanger 150 and thence via line 166, 168, and 80 into boiler make-up water holding tank 82. Flow across the paddle switch 156 will cause the flow switch 134 to close, thus sending a signal to valve operator 130 which will position the valve 132 to allow flow of blowdown water from the receiver 52, under steam pressure, via line 144, one-way valve 146, and the line 148 to the heat exchanger coil 158 and out of the heat exchanger through the back pressure regulating valve 162. This latter valve is installed in, the drain line 16, to assure that the pressure in the receiver 52 and associated piping through the heat exchanger 150 and to the inlet of the back pressure valve 162, did not drop below the saturation pressure of the water in the boiler. The water in the receiver 52 will be at a temperature of about 353° F. at a pressure of 125 p.s.i. gauge. In the absence of valve 162 and its pressure maintaining feature, the receiver and associated piping including the heat exchanger tubes 158 would be subject to possible damage due to a flashing of the hot water in the receiver 52 and associated appurtenances. Since this water is at boiler water temperature a condition of water and steam hammer which could damage the piping may result. The now cooled blowdown water exits via the line 160 and the pressure regulating valve 162 through the rate control valve 164 under conditions which maintain the pressure in the system. The valve 164 is especially selected to control the rate of flow from the receiver 52 through the coil 158 of the heat exchager 150 to maintain optimal heat transfer rates. A required back pressure to prevent flashing of blowdown water to steam is maintained by valve 162. The flow of coolant through the heat exchanger 150 is also closely controlled. As the coolant passes beyond the paddle switch 156 it passes through the flow rate regulating valve 157. This valve 157 very accurately controls the rate of flow of the coolant water for the same purpose that the flow of the blowdown effluent through the other side of the heat exchanger is controlled. It is important that the design flow rate be maintained for the maximun efficiency of the heat exchanger.

Blowdown cycles conducted in this manner in combination with the external heat exchanger 150 and the flow rate control flow valves in lines 160 and 152 and the back pressure regulating valve 164 are among the distinguishing features and improvements of this invention over the prior art.

At the end of the PURGE phase, coolant water flow through line 152 is stopped by the closing of the valve 154, flow of steam purge in line 50 is stopped by closing the valve 58 and simultaneously the valve 132 is driven to the dead shut-off position by the controller 130.

The last or CONDENSE phase commences with the opening of the valve 76 in line 74, allowing cooling water to flow through the jacket or coil 70 of the receiver 52 in order to decrease the purging pressure which takes approximately one and one half to two minutes. The pressure in the vessel 52 will have substantially reduced and again the time taken is pre-established and Timer $T_4$ set to time out the condense phase and stop operation of the system.

Additional distinguishing features of the instant process from the prior art at this point may be mentioned to include the use of the sample cooler 102 as an integral part of the system. The sample cooler functions to remove or mitigate pressure-temperature problems which result if the conductivity cell 96 in the monitor is pressed beyond its normal working range. The normal conductivity cell is designed to operate at a maximum temperature of 100° C. and at a pressure in the range of 10 to 15 lbs. per square inch. Most steam boilers operate at higher temperatures and pressures. Another distinguishing feature is the use of the external blowdown effluent heat exchange means 150. The prior art contemplates only cooling the blowdown effluent in the receiver 52. Due to the fact it would take a substantial period of time to cool the water withdrawn from the boiler at a single blowdown, severe limitations in the quantity of water which could be withdrawn every hour from the boiler would be imposed. The maximum capacity of the receiver 52 is directly related to the amount of water that can be taken from the boiler at any one moment without interupting its operation. This means that for a given boiler and a given receiver only so many blowdown cycles can be put into operation during an hour. With only the receiver 52 in the system. the cooling cycle time is very substantial because highly inefficient connective circulation is used in cooling the water.

Figure 2:
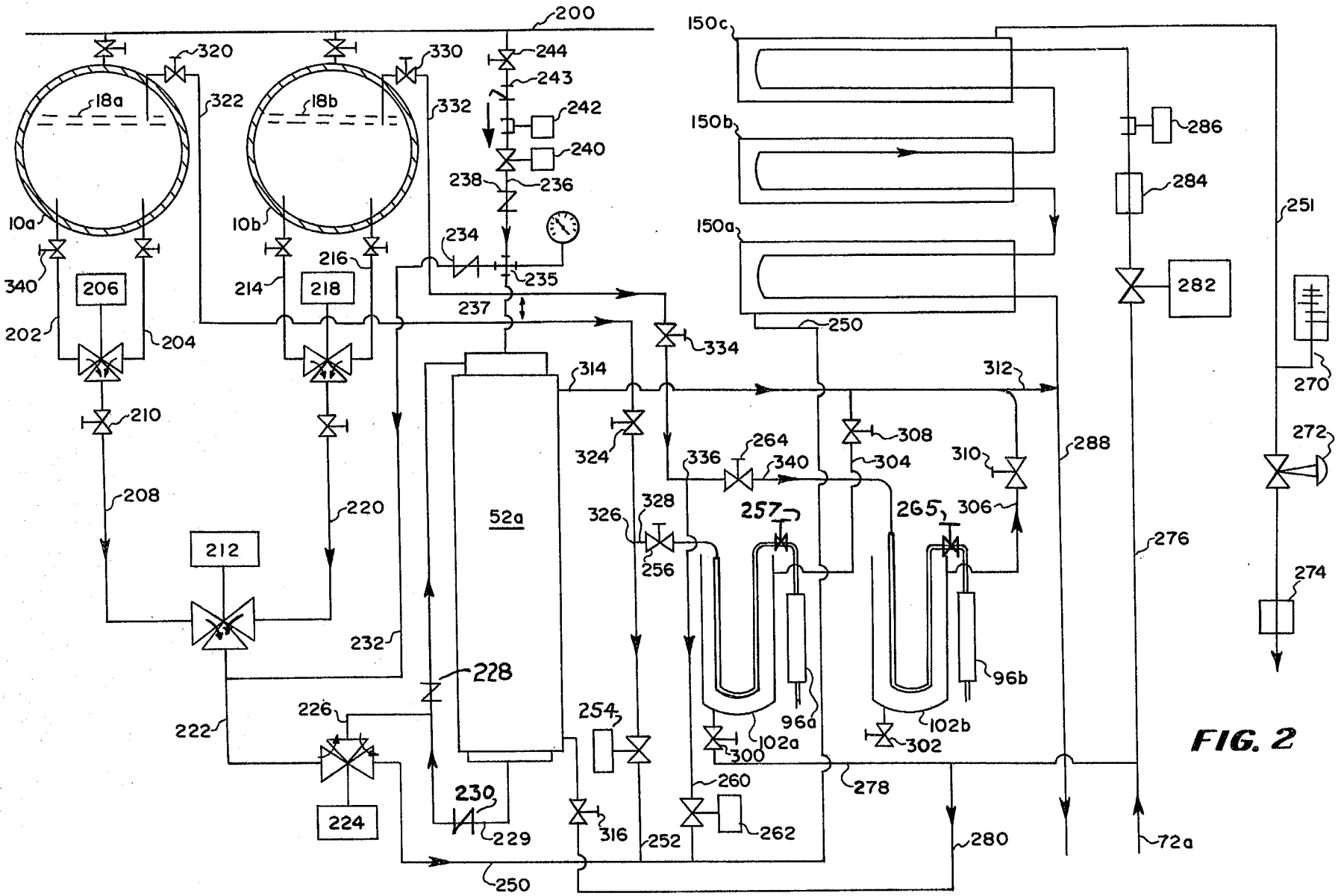
FIG. 2 is a diagramatic view of another form of apparatus of this invention wherein both bottom blowdown and surface blowdown from a pair of boilers each with bottom blowdown openings is automatically controlled and FIG. 3 illustrates a circuit diagram for the control of the embodiments shown in FIG. 2 which with disclosed modifications can also function to control the embodiment shown in FIG. 1.

Referring to FIG. 2 (wherein like units of FIG. 1 bear the same reference numerals) a system is disclosed for operating and controlling the blowdown cycles of two or more boilers, illustrated by the boilers 10*a* and 10*b*, each equipped with a valve controlled steam output line connected to a main header 200. The operating water levels of these boilers are indicated by the broken lines 18*a* and 18*b*. Each boiler would be equipped with a suitable safety valve etc. as described in conjunction with FIG. 1.

The boiler 10*a* has the pair of bottom-boiler water draw-off lines 202 and 204 which extend into the water therein and may be located at strategic positions in which the sediment tends to collect e.g. one or more of the lowest points in the boiler. The draw-off lines 202 and 204 connect to the motor valve 206 which is a three-way valve with the discharge line 208, having service valve 210 communicating with the boiler selector motor valve 212.

The boiler 10*b* has the pair of bottom boiler water draw-off lines 214 and 216 which connect to the motor valve 218 having a discharge line 220 connected to another inlet of the motor valve 212.

The common discharge line 222 from the last mentioned valve leads to one inlet of the motor valve 224. One of the outlet ports of the valve 224, communicates through the line 226, and one-way valve 228 to the jacketed receiver tank 52*a*. The discharge line 222 has the blowdown receiver relief line 232 which communicates through the one-way valve 234 from the juncture 235 of the steam pressure lines 236 and 237, the former being equipped with a one-way valve 238, the solenoid valve 240, the pressure switch 242, the strainer 243 and the service valve 244, leading from the main steam header 200 to the top of the receiver 52*a*. Directions of flow through the lines is indicated by the arrows.

In the BLOWDOWN phase, the bottom blowdown water from the valve 212 passes through the line 222, through the valve 224, and in the lines 226 and one-way valve 228 to the top of the receiver 52*a*. In the third (PURGE) phase of the cycle, the position of the valve 224, allows the blowdown water to pass from the full receiver 52*a* via the line 229, one-way valve 230, line 226 into the valve 224 in line 250, thence through the heat exchangers 150 to waste via lines 251, back pressure regulating valve 272 and flow rate control valve 274. These valves serve the same functions as valves 162 and 164 of FIG. 1.

The branch line 252 under the control of the motor valve 254 conveys the surface blow-off water from the line 322, to the line 250 passing through the heat exchanger 150 to the drain 72*a*. Likewise the branch line 260 under the control of the motor valve 262 conveys the surface blow-off water from the line 332 into the line 250. All of the boiler water thus passes through the bodies of the heat exchangers 150 and exits the system through the line 251, sensed by the thermometer 270, controlled the back pressure valve 272 and the flow rate control valve 274 to waste.

Coolant for the receiver 52*a* the sample coolers 102*a* and the heat exchangers 150 enters the system from the source 72*a*, having three branch lines: 276, 278, and 280. The branch line 276 supplies coolant to the heat exchangers 150 under the control of the motor valve 282, the flow rate valve 284 and the flow sensing switch 286, for return to the make-up water line 288 which terminates at the boiler feed water storage tank (not illustrated).

Coolant entering the line 278 passes through sample cooler 102*a* and 102*b* under the control of the service valves 300 and 302. The heated coolant exits the sample coolers via the lines 304 and 306 controlled by the needle valves 308 and 310, to line 312 for recycle via the make-up water line 288.

The branch line 280 carries coolant to the jacket of the receiver for return to the make-up storage through the return line 312 which connects to the recycle line 321. The flow of coolant herein is controlled by the solenoid valve 316.

The surface blow-off system includes, for boiler 10*a*, the service valve 320 in the line 322, and the service valve 324 leading to junction 326. The flow of boiler water for monitoring the system passing from the junction 326 in the line 328 controlled by the service valve 256 and through the coil in sample cooler 102*a* through the needle valve 257 to the conductivity cell 96*a*.

Similarly, for boiler 10*b*, the surface blow-off system includes the service valve 330, in the line 332, the service valve 334 and the junction 336. Boiler water samples pass via line 340 and severe valve 264 into the coil of the sample cooler 102*b*, then through the needle valve 265, then to cell chamber 96*b*, thence to waste.

Referring to FIG. 3 the line of heavy dots extending from the top right edge to the bottom right edge represents terminal board connections. The circle is used for relays or solenoid coils and the standard symbols for normally open and normally closed switches are used. Pilot lights may be used in the circuit as illustrated by appropriate symbol.

It is apparent that only slight changes in FIG. 3 would be required in order that the circuit be used in to control the apparatus and process of FIG. 1. These would include the elimination of the lead from the main on-off switch and all of the associated relays and switches controlling the surface blow-off valves 254 and 262 as well as the flow switch 286. The normally open switch $RC_2$ leading to timer $T_1$ would not be needed as well as the connections between relay A1+ and associated controls for conductivity cell 96*b*, SW2-1, and the pilot light therefor. Also all of the associated controls for motor valve 212 would be eliminated. This means that valve 224 of the FIG. 3 will assume the function of valve 130–132 in FIG. 1 and the valve 282 will function as valve 136 of FIG. 1.

With the foregoing circuit changes in mind it is apparent that the following sequence of steps may take place in the operation of the apparatus of FIG. 1.

1. When control panel door is closed and ON-OFF switch is OFF, valve 136 will be in closed position.
2. When ON-OFF switch is ON and the pressure sensor 54 senses steam pressure to its set point, it closes, thus energizing conductivity monitor 96.
3. If SW1-1 (part of the monitor circuit) closes due to signal received from conductivity cell located in cell chamber 96, relay RB is energized.
4. Starting timer $T_1$ and driving valve 130–132 to its second position (BLOWDOWN) opening to the line 140.
5. After T1 times out relay F and timer T2 will be energized, valves 154 and 58 open and on sensing coolant flow thru flow sensitive device 156, flow switch 134 will close and valve 132 will drive to the (PURGE) 3rd position. Flow of blowdown water will be from receiver 52, through line 144, via valve 132, to line 148 and into heat exchanger 150 and thence to waste.
6. After T2 times out, timer T3 and relay Rg are energized, and valves 58 and 154 close; valve 76 opens; and valve 132 drives to (CONDENSE), its' 1st or closed position.
7. After T3 times out, valve 76 closes and control system re-sets to step 3 above.

Considering FIG. 2 and FIG. 3 together the following sequence of operations takes place:

When control panel door is closed, the door switch is closed, valve 282 goes closed (if not already closed).

1. If pressure sensitive switch 242 senses steam pressure, it closes energizing relay RA. Power is maintained onto the "closed" terminal of 282.
2. Conductivity monitors 96*a* and 96*b* are energized.
3. When either SW-1 of SW-2 (part of the monitoring system) closes (due to a rise in electrical conductivity in the boiler water crossing associated conductivity cell in 96*a* or 96*b*); either RB & RD (if SW1-1 closes) will be energized will start timing cycle of T1. The valve 212 then drives to allow flow of boiler blowdown water from boiler 18*a* (if SW1-1 is closed first) or the boiler 18*b* if Sw2-2 closes. This simultaneously drives the valve 224 to the blowdown position. At this point in the operation an alternator (not shown) would position the valve 206 or the valve 218 so as to with boiler water from the ends of the boilers opposite those of a previous blowdown, through lines 202–204 and the lines 214–216. More than two such blowdown positions may be serviced with different valve confirmation or its deletion.
4. After T1 times out, relay RF and timer T2 will be energized and valves 282 and 240 will open. Flow switch FS1 within the flow sensing device 286, on sensing coolant flow, will close driving 224 to PURGE or 3rd position.
5. After T2 times out, relay RG and timer 3 will be energized. Valve 240 and 282 will close, valve 316 will open and valve 224 will drive to the CONDENSE (1st or closed) position. This allows cooling water to flow through the jacket of the receiver 52*a* to remove heat therefrom and condense the residual steam therein. Simultaneously with the above, power will flow to both SW1-2 and SW2-2 (in the monitoring system 96*a* or 96*b*). If either or both of these switches are closed (due to electrical conductivity level in boiler water) relay RH or RJ will be energized and valve 282 will drive open. On sensing coolant flow FS2 (within flow sensing device 286) will allow either or both valves 254 or 262 to open. This allows flow from the surface blow-off connections 322 and 332 into the heat exchangers 150 via line 250. If the solids level in the boiler 18*a* or 18*b* drop below the set point of the respective monitors 96*a* or 96*b*, controlling SW1-2 or SW2-2, the valve 254 or 262 will close.

6. After timer T3 times out timer T4 is energized. Position of valves 282, 254, and 262 is unaffected and remains under control of SW1-2 or SW2-2. If, during timing period of T4 either or both of these switches open respective valve 254 or 262 will close. If both, open, 282 will also close. When T3 times out the valve 316 closes, stopping the flow of coolant water to the jacket of the receiver.
7. At the end of timing period of T4 the entire control cycle reverts to step 3 above and repeats as required. At this time the valves 254, 262 and 282 will close regardless of the position of switches Sw1-2 and SW2-2 thus stopping the surface blow off from either or both boilers.
8. If SW1-1 and SW2-1 are both closed at any time during the above cycle, the alternator relay coil (ALT) will be energized and valve 212 will assume its' opposite position (i.e. boiler #1 vs. #2). This assures alternate blowdowns from each boiler as required.

I claim:

1. A boiler blowdown apparatus for a boiler having a steam outlet and a bottom blowdown outlet, which comprises:

means for receiving blowdown water from said bottom outlet of said boiler, said receiving means having a one-way top inlet, and a one-way bottom outlet to conduct said blowdown water therefrom and a first valve-controlled steam pressure conduit connected to said steam outlet of said boiler;

heat exchanger means connected to said one-way bottom outlet of said receiving means for cooling said boiler water;

second valve means, normally closed in a first position, adapted to control the flow of blowdown water from said boiler into the top inlet of said receiving means in a second position and adapted to allow the flow of blowdown water from the bottom outlet of said receiving means in a third position;

means monitoring a condition of said boiler water in said boiler to produce a signal to indicate the need for a blowdown cycle;

means responsive to said signal to operate said second valve means in timed sequence from said first position to said second position and thereby pass a portion of blowdown water from said boiler to charge said receiving means;

timing means for controlling the duration of the flow of blowdown water from said boiler to said receiving means and for producing a second signal;

cooling water control means responsive to said second signal;

means to produce a third signal to indicate the flow of coolant water through said heat exchanger means;

means responsive to said third signal to operate said second valve means from said second position to said third position and thereby pass blowdown water from said receiving means and simultaneously open said first valve means of said steam pressure conduit to purge said receiving means and pass said boiler water to said heat exchanger means; and, means controlling the rate of cooling of said water and the rate of discharge from said heat exchanger means.

2. A boiler blowdown apparatus to serve two or more boilers simultaneously in accordance with claim 1 comprising:

signal-responsive multiport valve means to selectively control water flow from the bottom of a selected boiler to said receiving means.

3. A boiler blowdown apparatus for a boiler in accordance with claim 1, including:

pressure control means to limit pressure in said receiving means;

means to produce a signal to terminate said period during which said receiving means is in communication with said heat exchanger means; and, means to drive said second valve means to said normally closed first position.

4. A boiler blowdown apparatus for a boiler having a steam outlet and a bottom blowdown outlet, which comprises:

means for receiving blowdown water from said bottom outlet of said boiler, said receiving means having a one-way top inlet, and a one-way bottom outlet to conduct said blowdown water therefrom and a first valve-controlled steam pressure conduit connected to said steam outlet of said boiler;

means for cooling said receiving means to condense residual steam therein;

heat exchanger means connected to said one-way bottom outlet of said receiving means for cooling said boiler water;

second valve means, normally closed in a first position, adapted to control the flow of blowdown water from said boiler into the top inlet of said receiving means in a second position and adapted to allow the flow of blowdown water from the bottom outlet of said receiving means in a third position;

means monitoring a condition of said boiler water in said boiler to produce a signal to indicate the need for a blowdown cycle;

means responsive to said signal to operate said second valve means in timed sequence from said first position to said second position and thereby pass a portion of blowdown water from said boiler to charge said receiving means;

timing means for controlling the duration of the flow of blowdown water from said boiler to said receiving means and for producing a second signal;

cooling water control means responsive to said second signal;

means to produce a third signal to indicate the flow of coolant water through said heat exchanger means;

means responsive to said third signal to operate said second valve means from said second position to said third position and thereby pass blowdown water from said receiving means and simultaneously open said first valve means of said steam pressure conduit to purge said receiving means and pass said boiler water to said heat exchanger means; and, means controlling the rate of cooling of said water and the rate of discharge from said heat exchanger means.

5. A boiler blowdown apparatus to serve two or more boilers simultaneously in accordance with claim 4 comprising:

signal-responsive multiport valve means to selectively control water flow from the bottom of a selected boiler to said receiving means.

6. A boiler blowdown apparatus for a boiler in accordance with claim 4, including:

pressure control means to limit pressure in said receiving means;

signal-responsive valve means to allow the flow of coolant through said cooling means of said receiving means;

means to produce a signal to terminate said period during which said receiving means is in communication with said heat exchanger means; and, means to drive said second valve means to said normally closed first position.

7. A boiler blowdown system for a boiler having a blowdown outlet, which comprises:

means for receiving a predetermined volume of said boiler water from said blowdown outlet of said boiler;

said receiving means having a steam inlet communicating with said boiler and a bottom outlet;

heat exchanger means in communication with said bottom outlet of said receiving means and having a source of cooling water;

three-position valve means adapted to control the flow of blowdown water to and from said receiving means having a first normally closed position, a second position allowing flow of boiler water from said boiler to said receiving means and a third position allowing flow of said boiler water from said bottom outlet to said heat exchanger means;

two-position valve means controlling the flow of steam from said boiler into the top of said receiving means;

means to monitor a condition of said boiler water and produce a signal indicating the necessity for a blowdown cycle;

electrical control means responsive to said signal to move said three-position valve means to its second position for a predetermined time to charge said receiving means with boiler water;

timing means for controlling the duration of flow of blowdown water to said receiving means and for producing a signal;

signal-responsive means, responsive to said signal to control the flow of cooling water to said heat exchanger means and thereby producing a signal;

flow responsive means to develop a signal upon the establishment of cooling water flow through said heat exchanger means;

control means responsive to said signal developed by said flow responsive means to open said two-position valve means and allow the flow of steam from said boiler into said receiving means to purge said boiler water therefrom; and, control means responsive to said signal developed by said flow responsive means to move said three-position valve means to said third position to discharge said water from said receiving means through said heat exchanger means and to waste.

8. A boiler blowdown system to serve two or more boilers simultaneously in accordance with claim 7 comprising:

signal-responsive multiport valve means to selectively control water flow from the bottom of a selected boiler to said receiving means.

9. A boiler blowdown system for a boiler in accordance with claim 7, including:

steam pressure sensing means to produce a first signal.

10. A boiler blowdown apparatus for a boiler having a top steam outlet, a surface blow-off outlet and a bottom blowdown outlet, which comprises:

means for receiving a predetermined volume of said boiler water from said boiler;

said receiving means being in communication through its top with said steam outlet of said boiler, and in communication with said bottom blowdown outlet of said boiler;

valve means controlling the flow of steam from said boiler to said receiving means at predetermined times to define a purge phase;

said receiving means being in intermittent communication with said blowdown outlet from said boiler;

heat exchanger means to cool said pre-determined volume of said boiler water;

said receiving means being in top communication with said steam outlet and in bottom communication with said heat exchanger means;

means for circulating a cooling medium in indirect contact with said boiler water in said heat exchanger means;

signal-responsive valve means controlling the flow of boiler water from the surface blow-off outlet of said boiler to said heat exchanger means with no direct communication with water in the bottom of said boiler and said heat exchanger means; and, means to continuously monitor a condition of water in said boiler and adapted to produce a signal to open said signal-responsive valve means, and thereby cycle a portion of said boiler water from the bottom of said boiler to said receiving means.

11. A boiler blowdown apparatus to serve two or more boilers simultaneously in accordance with claim 10 comprising:

signal-responsive multiport valve means to selectively control water flow from the bottom of a selected boiler to said receiving means.

12. A bottom blowdown system for a boiler comprising:

means for receiving said blowdown water from said boiler;

said receiving means having a steam inlet communicating with said boiler and an outlet;

valve means for said blowdown water having a first normally closed position, a second open position allowing communication from the bottom of said boiler to said receiving means and a third position allowing communication from said outlet of said receiving means to said heat exchanger means;

control means for said steam inlet of said receiving means to allow steam to enter said receiving means;

control means for said source of coolant for said heat exchanger means;

said heat exchanger means for said bottom blowdown water having a source of coolant;

a steam inlet communicating with said boiler having a pressure sensor; and, an outlet from said receiving means communicating with said heat exchanger means.

13. A bottom blowdown system to serve two or more boilers simultaneously in accordance with claim 12 comprising:

signal-responsive multiport valve means to selectively control water flow from the bottom of a selected boiler to said receiving means.

14. A boiler blowdown system in accordance with claim 12, wherein:

said receiving means for said blowdown water from said boiler has a source of coolant.

15. A bottom blowdown system for a boiler comprising:

receiving means having an inlet for said bottom blowdown water from said boiler;

said receiving means having a steam pressure conduit communicating with said boiler and an outlet for said blow-down water;

heat exchanger means communicating with said blow-down water outlet of said receiving means and having a source of coolant;

control means in the steam pressure conduit communicating with said boiler to produce a first signal upon attaining a predetermined pressure in said steam pressure conduit;

motor-driven valve means responsive to actuating signal for each of the three positions having a first normally closed position, a second position allowing communication between said inlet of said receiving means and the bottom of said boiler and a third position allowing communication from said outlet of said receiving means to said heat exchanger means;

means to monitor a condition of said boiler water to produce a signal indicating the necessity for a blowdown cycle; and, electrical control means responsive to said signal from said monitoring means to sequentially produce additional signals to selectively actuate said motor-driven valve means to said three positions and to selectively actuate, in desired sequence, the starting and stopping of the flow of coolant water through said heat exchanger means, the starting and stopping of the flow of steam to said receiving means, and the starting and stopping of the flow of coolant water to the receiving means.

16. A bottom blowdown system to serve two or more boilers simultaneously in accordance with claim 15 comprising:

signal-responsive multiport valve means to selectively control water flow from the bottom of a selected boiler to said receiving means.

17. A bottom blowdown system for a boiler in accordance with claim 15, wherein:

said receiving means has a source of coolant.

18. A boiler blowdown system for a boiler having a top steam outlet and a bottom blowdown drain, which comprises:

means for receiving a predetermined volume of said boiler water from the blowdown drain of said boiler and having a bottom outlet;

heat exchanger means in communication with said bottom outlet of said receiving means;

three-position valve means, normally closed in a firs. shut-off position, adapted to control the flow of blowdown water from said boiler to said receiving means in a second position, and adapted to allow the flow of said blowdown water from said receiving means to said heat exchanger means in a third position;

a source of steam for said receiving means;

a source of cooling water for said heat exchanger means;

means to independently control said source of steam and cooling water;

means to monitor a condition of said boiler water adapted to produce a signal indicating the necessity for a blowdown cycle; and, electrical control means responsive to said signal indicating the necessity for a blowdown cycle, which sequentially produce additional signals to selectively actuate said threeposition valve means to said three positions and selectively actuate, in desired sequence, the starting and stopping of the flow of coolant water through said heat exchanger means, the starting and stopping of the flow of steam to said receiving means, and the starting and stopping of the flow of coolant water to the receiving means.

19. A boiler blowdown system to serve two or more boilers simultaneously in accordance with claim 18 comprising:

signal-responsive multiport valve means to selectively control water flow from the bottom of a selected boiler to said receiving means.

* * * * *